United States Patent [19]

Cachola

[11] 4,384,718

[45] May 24, 1983

[54] GOLF STANCE AND SWING PRACTICE DEVICE

[75] Inventor: Richard H. Cachola, Detroit, Mich.

[73] Assignee: Michael J. Piperides, Warren, Mich.

[21] Appl. No.: 290,691

[22] Filed: Aug. 6, 1981

[51] Int. Cl.[3] ..... A63B 69/36

[52] U.S. Cl. ..... 273/187 R; 273/186 C

[58] Field of Search ..... 273/187 R, 187 A, 183 A, 273/186 C, 187 B

[56] References Cited

U.S. PATENT DOCUMENTS

| | | | |
|---|---|---|---|
| 1,484,390 | 11/1922 | Gibbs et al. | 273/187 A |
| 1,517,555 | 12/1924 | Graham | 273/187 R |
| 1,922,130 | 8/1929 | Haserodt | 273/187 R |
| 2,169,407 | 8/1939 | Crowley | 273/187 R |
| 2,189,613 | 2/1940 | Paulsen | 273/187 R |
| 2,606,026 | 8/1952 | Young | 273/187 R |
| 2,707,638 | 5/1955 | Manley | 273/187 A |
| 2,777,697 | 1/1957 | Crossot | 273/187 R |
| 2,941,808 | 6/1960 | Smith et al. | 273/187 R |
| 3,166,327 | 1/1965 | Champion | 273/187 R |
| 3,229,981 | 1/1966 | Taber | 273/187 R |
| 3,300,219 | 1/1967 | Sipos | 273/187 R |
| 3,343,268 | 9/1967 | Schennum | 273/187 R |
| 3,784,208 | 1/1974 | Weygandt | 273/183 A |
| 3,860,247 | 1/1975 | Taylor | 273/186 C |
| 3,868,109 | 2/1975 | Fowler | 273/187 A |
| 3,920,248 | 11/1975 | Medders | 273/187 R X |
| 4,000,905 | 1/1977 | Shirhall | 273/187 A |
| 4,101,130 | 7/1978 | Richards | 273/187 A |
| 4,146,231 | 3/1979 | Merkle et al. | 273/187 R |
| 4,164,352 | 8/1979 | O'Brien | 273/187 A |

FOREIGN PATENT DOCUMENTS

| | | | |
|---|---|---|---|
| 16930 | of 1911 | United Kingdom | 273/187 R |
| 1305710 | 7/1973 | United Kingdom | 273/187 R |
| 1461508 | 1/1977 | United Kingdom | 273/187 R |

*Primary Examiner*—George J. Marlo

*Attorney, Agent, or Firm*—Hauke and Patalidis

[57] ABSTRACT

A golf stance and swing practice device in the form of three elongated flat strips of material such as metal or plastic hingedly and adjustably interconnected. The first strip is disposed generally with its longitudinal axis perpendicular, within a limited range of angles, to the longitudinal axis of the second and third strips. The third strip is mounted on the end of the first strip, and the first strip is mounted pivotably on the second strip at an adjustable distance from the third strip. The third strip provides an indexing arrangement for ball placement and direction of ball flight. The second strip has a scale for foot placement for appropriate stance and the first strip has a scale for providing reach for properly addressing the ball placed above the first strip at a predetermined distance thereof. The indexing arrangement for ball placement relative to the third strip consists of circles and lines disposed on the surface of the third strip. The third strip has a slot where attached on the end of the first strip such as to be longitudinally adjustable relative to the first strip. The first strip has a longitudinal slot where connected to the second strip for providing disposing the second strip at an appropriate distance from the third strip along the scale on the first strip. Angle markings are provided on the second strip where joined to the first strip and on the first strip where joined to the third strip for disposing the second and third strips at an angle relative to the first strip.

7 Claims, 10 Drawing Figures

52 54 56 50
| | A | B | C |
|---|---|---|---|
| | BALL POSITION | VERTICAL | FOOT POSITION |
| WOODS #1 | 1 | 25 | 17 |
| #2 | 1 | 24 1/2 | 17 |
| #3 | 1 | 24 | 17 |
| #4 | 1 | 23 1/2 | 17 |
| #5 | 1 | 23 | 17 |
| IRONS #1 | 1 OR 2 | 22 | |
| #2 | 1 OR 2 | 21 1/2 | |
| #3 | 1 OR 2 | 21 | |
| #4 | 1 OR 2 | 20 1/2 | |
| #5 | 1 OR 2 | 20 | |
| #6 | 2 OR 3 | 19 1/2 | |
| #7 | 2 OR 3 | 19 | |
| #8 | 2 OR 3 | 18 1/2 | |
| #9 | 2 OR 3 | 18 | |
| WEDGE | 2 OR 3 | 18 | |
FIG. 3
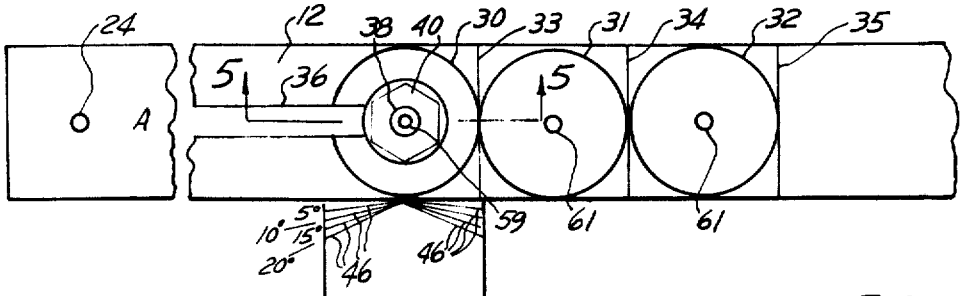
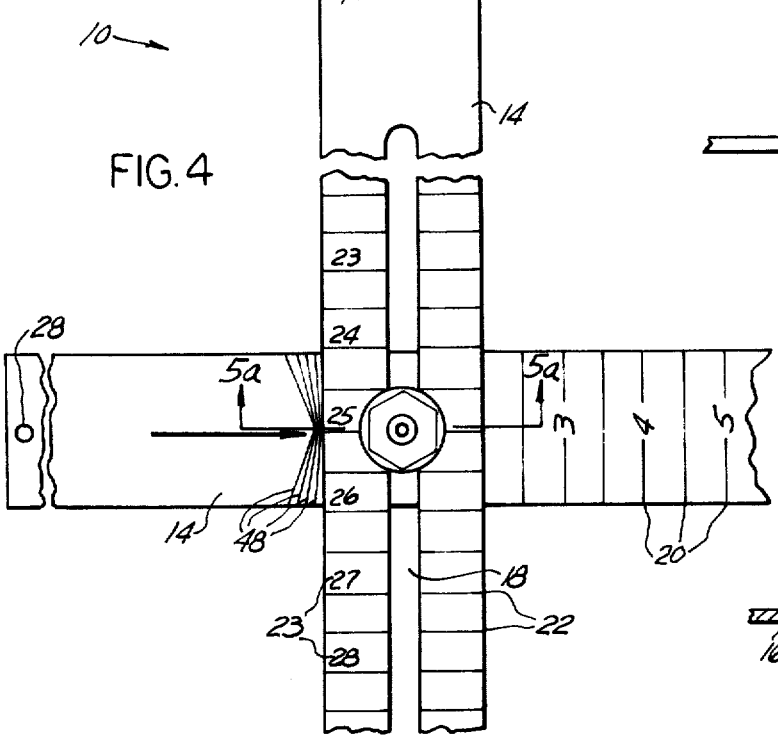
FIG. 4
FIG. 5
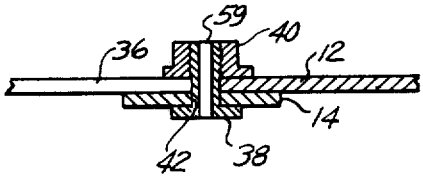
FIG. 5a
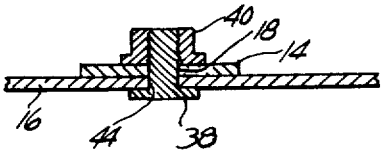

STRAIGHT SHOT

FADE SHOT OR CONTROLLED SLICE

DRAW SHOT OR CONTROLLED HOOK

PUTTING

GOLF STANCE AND SWING PRACTICE DEVICE

BACKGROUND OF THE INVENTION

The present invention is a golf stance and swing practice device for aiding a golfer in adopting a proper stance and balance for driving a golf ball along a straight predetermined path for effecting straight shots, and also for effecting draw and fade shots, and for putting.

Golf swing indicating devices providing feet and ball positioning are known in the art. However they are generally either too complicated for practical use, or too cumbersome to be carried around in a golf bag, or they are so simplified that they turn out to be a useless gadget incapable of providing a golfer with accurate guide lines for repetitive performance.

It is generally recognized by golf professionals, expert golfers and golf instructors that a proper stance and a correct addressing of the ball, together with ease and balance of the golfer, are important aspects of the game. There are certain requirements for hitting the ball in a desired direction, either along a straight line for straight shots, or along a curved line for fade shots or controlled slicing and for draw shots or controlled hooking. The requirements include correct placement of the feet relative to the direction of the shot and to the position of the ball, proper stance and balance, such that the golf head properly impacts the ball for distance and for causing the ball's trajectory to be substantially along the desired path.

The present invention provides a simple device, useful to a novice as well as to an expert golfer for improving his game, useful to instructors as a teaching aid, which is economical to manufacture and which is readily portable in a golf bag.

SUMMARY OF THE INVENTION

The present invention accomplishes its objects and purposes by providing a suitable frame which may be easily set up and which, when placed on the ground, provides guidelines and reference location for a golfer's feet and for a golf ball for executing accurately and repetitively diverse shots, and which provides appropriate alignment for the arm swing and for the club head for effecting a desired shot to an appropriate distance and in a desired direction.

These and other advantages of the present invention will become apparent to those skilled in the art when the following description of the best mode contemplated for practicing the invention is read in conjunction with the accompanying drawings wherein:

BRIEF DESCRIPTION OF THE DRAWINGS

FIG. 3 is an example of individualized chart for use with the present invention;

FIG. 4 is an enlarged partial top plan view of the invention;

FIGS. 5 and 5*a* are sections along lines 5—5 and 5*a*—5*a*, respectively, of FIG. 4;

DETAILED DESCRIPTION OF THE PREFERRED EMBODIMENTS

Figure 1:
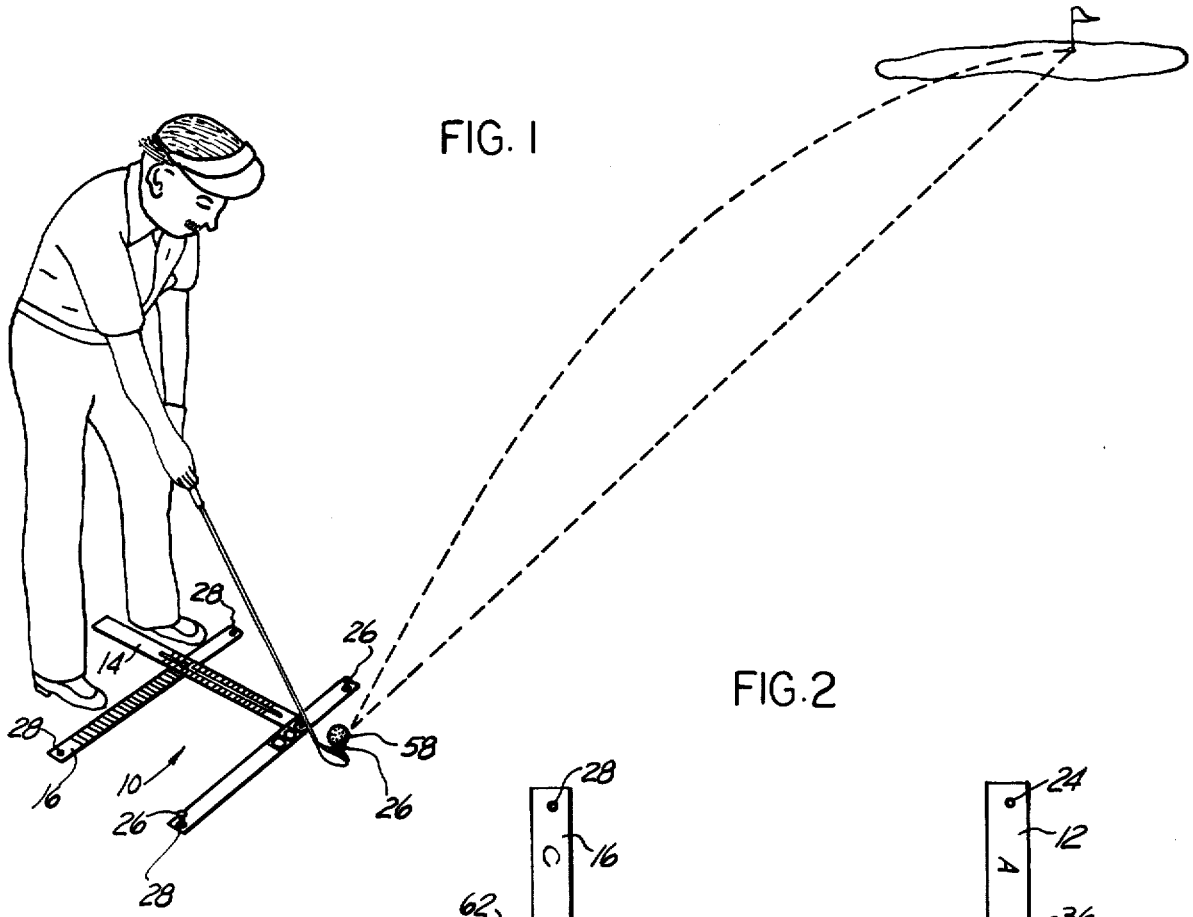
FIG. 1 is a perspective view of a golf stance and swing practice device according to the present invention, shown in use by a golfer.

Referring to the drawing, and more particularly to FIGS. 1-5 thereof, a golf stance and swing practice device 10 according to the present invention comprises three flat rectangular relatively thin strips, substantially of equal length, and designated for convenience as the A strip 12, the B strip 14 and the C strip 16. Each of the strips is made of flat metal or, preferably of a flat rectangular length of plastic such as polyvinyl chloride or high impact styrene, for example. The A strip 12 and C strip 16 are removably and pivotably attached to the B strip 14 and, in use, are generally disposed at right angle to the B strip 14, the A strip 12 being attached at an end of the B strip 14, and the C strip 16 being attached at some intermediate point along a slot 18 running part of the length of the B strip 14. Both the B strip 14 and the C strip 16 are provided with regularly spaced lines defining graduations 20 and 22, respectively, and with distance indicating numerical indicia 21 and 23, respectively, indicating distances. The scale formed by the graduations 22 on the C strip 16 relates to distances, in inches or centimeters as the case may be, from the left edge of the B strip 14, for correct foot positioning for correct stance by a golfer. The scale formed by the graduations 20 and the corresponding numerical indicia on the B strip 14 indicate distances for positioning the C strip 16 by means of the slot 18 at an appropriate distance from the top edge of the A strip 12, for proper reach to address the ball according to the golf club used by the golfer. The A strip 12 is provided at each end with an aperture 24, so that it may be positioned on the ground, if so desired, by means of, for example, tees 26, FIG. 1. The B strip 14 may also be provided with an aperture 27, for the same purpose, FIGS. 2 and 4, and the C strip 16 with a pair of apertures 28. The surface of the A strip 12 is provided with three circles 30, 31 and 32, of a diameter equal to the diameter of a golf ball, namely 1.68" for conventional golf balls in use in the United States. The three circles 30, 31 and 32 are provided with tangent lines 33, 34 and 35 which are perpendicular to the longitudinal axis of the A strip 12.

The A strip 12 has, preferably, a longitudinal slot 36 extending from the center of the circle 30 to an appropriate distance to the left, as viewed in the drawings, corresponding to three golf ball positions, for a purpose to be indicated hereinafter.

The A strip 12 and the C strip 16 are pivotally and adjustably connected to the B strip 14 by any convenient means such as, for example, a bolt 38 and a nut 40, a bolt 38 being passed through an aperture 42 in the B strip 14, FIG. 5, and through the slot 36 in the A strip 12, a nut 40 holding the elements in pivotal interconnection. In a similar manner, a bolt 38 passed through an aperture 44 in the C strip 16 and the slot 18 in the B strip 14, together with a nut 40, holds the B strip 14 and the C strip 16 in pivotal and slidable connection along the slot 18. The B strip 14 is provided, as best shown at FIG. 4, with angle graduations 46, the first of which indicate proper alignment at right angle of the A strip 12 relative to the B strip 14, and the other of which indicate, for example, angles of 5°, 10°, 15° and 20°, respectively. Similarly, the C strip 16 is provided with angle indicating graduations 48 permitting the user to correctly angle the C strip 16 relative to the B strip 14 in one direction or the other at, for example, 0°, 5°, 10°, 15° and 20°.

Prior to using the golf stance and swing practice device 10 of the invention, a golfer fills a chart, such as the chart 50 of FIG. 3, according to instructions supplied to him as part of the kit including the device 10. The device of the invention is of universal use, irrespective of the height or shoulder width of a particular person. The determining factor for filling the chart 50 is the shoulder width of the person and the proper stance is assumed at first to be the same as the shoulder width. The chart 50 has three columns, a column 52 designated "A", "Ball Position", and referring to the ball positions 30, 31 and 32 on the A strip 12, which correspond respectively to the ball positions #1, #2, and #3, a column 54 designated "B", "Vertical", and referring to the graduations on the B, or "Vertical" strip 14, and a column 56 designated "C", "Foot Position", and referring to the position of the right foot, for a right-handed golfer, along the scale of the C, or "foot position", strip 16. The chart 50 has initially horizontal blank columns for woods from #1 to #5 wood and irons from #1 iron to #9 iron, and one column for wedge. The column 52, or "Ball position" column indicates that the ball position is position #1 for all woods, and #1 or #2 for irons #1 to #5 and ball position #2 or #3 from iron #6 through wedge. The column 54 is filled by the user according to a negative progression by half inch increments from 25" to 23" for #1 wood to #5 wood and from 22" to 18" for #1 iron through #9 iron or wedge, those figures corresponding to a shoulder width or stance of 17". For other shoulder widths, the user fills up the columns 54 and 56 of the chart 50 with appropriate numerical values as suggested by the instruction manual accompanying the golf stance and swing practice device of the invention.

Figure 2:
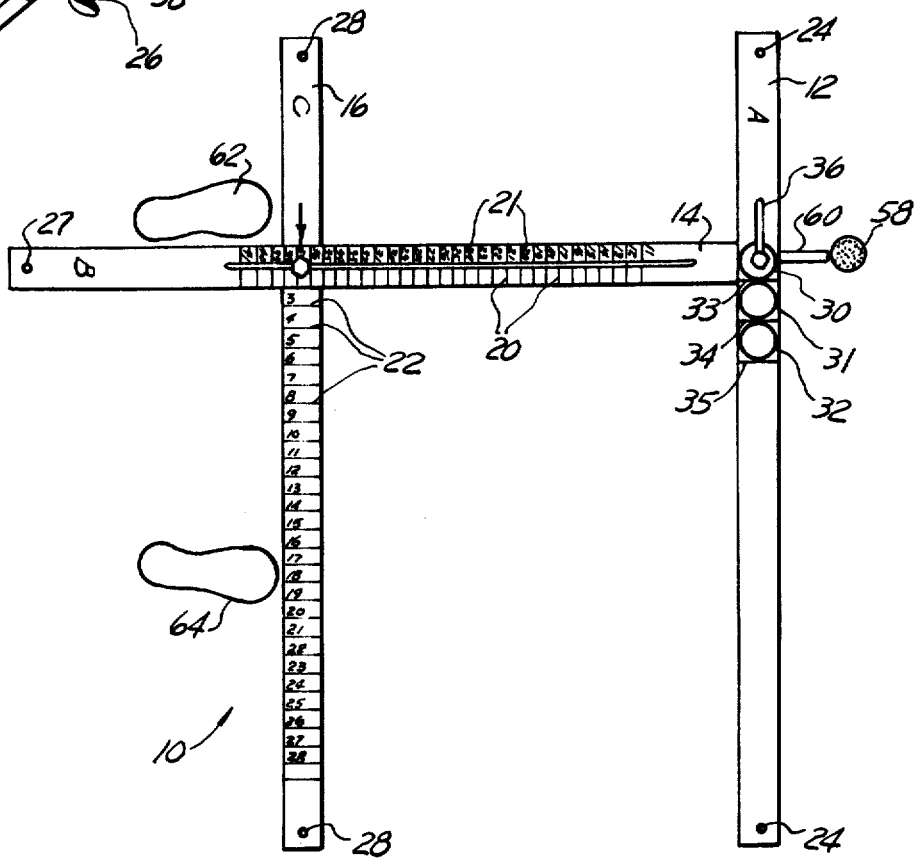
FIG. 2 is a top plan view of the golf stance and swing practice device of the invention.

The device 10 is placed on the ground, and the A strip 12 is aligned substantially with the direction of the shot. The B strip 14 is disposed with its longitudinal axis substantially at right angle to the longitudinal axis of the A strip 12 and the nut 40 is hand-tightened. The C strip 16 is also positioned along the slot 18 substantially at right angle to the B strip 14 at an appropriate distance such that the arrow on the C strip 16 is aligned with one of the graduations 20 on the B strip 14. By consulting the chart 50, FIG. 3, and assuming that it is desired to effectuate a drive shot with a #1 wood, the chart indicates that, for a right-hand golfer having a shoulder width of 17", the arrow on the C strip 16 is aligned with the 25" graduation or marking on the B strip 14. The ball, shown at 58 at FIGS. 1 and 2 is placed 5" from the top edge of the A strip 12 in alignment with the ball position #1, represented by the circle 30. A ball positioner ruler 60 is used for locating the ball 58 at an appropriate position 5" away from the upper edge of the A strip 12, such that the distance between the lower edge of the C strip 16 to the ball 58 is 30". The ball positioner ruler 60 may be provided with a hooked end, not shown, which is introduced in an aperture 59 in the end of the bolt 38, FIG. 5 for placing the ball 58 in ball position #1, or in holes 61, FIG. 4, in the center of circles 31 and 32 designating the ball positions #2 and #3. The golfer places his left foot, as indicated at 62 at FIG. 2, with the heel proximate the left edge of the B strip 14, within ¼" thereof, and with the tip proximate the lower edge, at ¼" or less, of the C strip 16. The right foot is positioned, as shown at 64, with the tip of the foot proximate the lower edge, within ¼", of the C strip 16 aligned with the 17" graduation 22. This provides the golfer with an appropriate stance of about 17". The line 33 on the A strip 12 between the circles 30 and 31 provides the golfer with a reference line for aligning the face of the club head for striking the ball 58, such that the trajectory of the ball is substantially on a straight line parallel to the longitudinal axis of the A strip 12.

Figure 6:
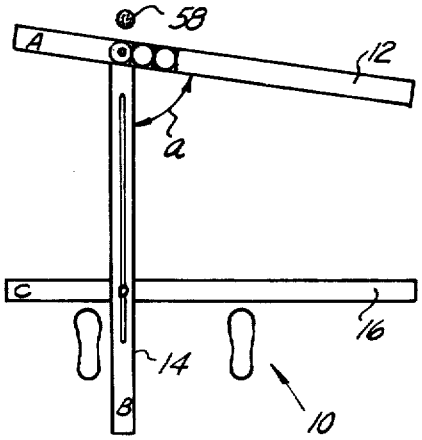
FIG. 6 is a schematic top plan view of the invention illustrating the manner in which the invention is set up for effecting a straight shot.

For each shot, depending on the club used, the C strip 16 is displaced along the slot 18 of the B strip 14 to a position corresponding to the marking indicated at column 54 of the chart 50, FIG. 3. In actual use, in order to effectuate a straight shot, the C strip 16 is disposed at a right angle to the B strip 14, FIG. 6, and the A strip 12 is disposed at an angle a of about 75°-80° to the B strip 14, the ball 58 being in the position #1 corresponding to the circle 30 on the A strip 12 for a wood shot, or aligned with the ball second position corresponding to the circle 31 for a shot using a #1 to #5 iron, or to the position corresponding to the circle 31 or the circle 32 for a shot effected with a #5 iron to a #9 iron, or with a wedge. For the shots effected with irons or wedge, the stance will generally be narrower than 17", for the numerical example given for illustrative purpose, for best balance.

Figure 7:
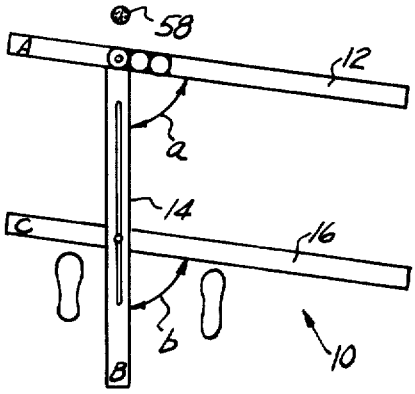
FIG. 7 is a view similar to FIG. 6 but schematically illustrating a setup for effecting a draw shot.

For effecting a draw shot, the A strip 12 is placed at an angle a of 75°-80° relative to the B strip 14, and the C strip 16 is also disposed at an angle b of 75°-80° relative to the B strip 14, such as the A strip 12 and the C strip 16 are substantially parallel, FIG. 7.

Figure 8:
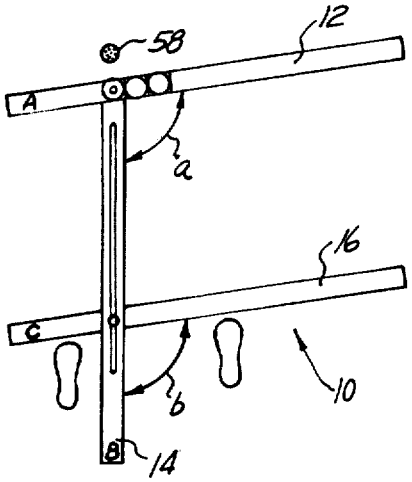
FIG. 8 is a view similar to FIGS. 6 and 7, but showing the setup for effecting a fade shot.

In order to effectuate a fade shot, FIG. 8, the A strip 12 is disposed at an angle a of about 105°-110° to the B strip 14, and the C strip 16 is also disposed in the same angular relationship with respect to the B strip 14, such that the A strip 12 and the C strip 16 are substantially parallel.

In every shot, the club head should follow the direction of the longitudinal axis, or edge, of the A strip 12 during the back swing and the down stroke.

The device of the invention is useful for right-handed golfers as well as left-handed golfers. When used by a left-handed golfer, the disposition of the A strip 12 and the C strip 16 relative to the B strip 14 form a mirror image of that illustrated, such that the longer portions of the A strip 12 and of the C strip 16, instead of being positioned on the right-hand side of the B strip 14, are disposed on the left-hand side of the B strip 14. The reference arrow, FIG. 4, on the C strip 16 for alignment with the distance graduation markings 20 on the B strip 14, can be used by left-handed golfers as well as right-handed golfers.

Figure 9:
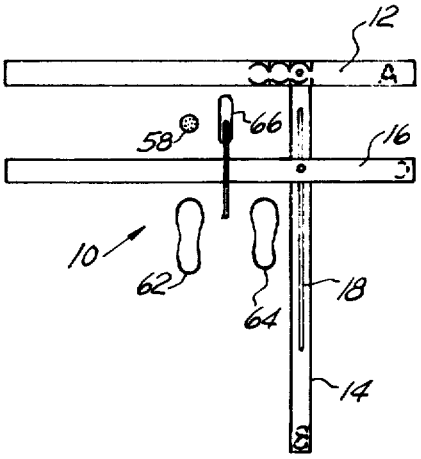
FIG. 9 is a schematic view illustrating the use of the invention as an aid for putting.

The device of the invention also has usefulness as an aid and training device for putting. Such a use is illustrated at FIG. 9, and it can be seen that for use in putting the device 10 is reversed on the ground, such that the B strip 14 is disposed adjoining the exterior of the right foot 64 and the C strip 16 is displaced along the slot 18 of the B strip 14, almost to the top of the slot 18 and tightened in position such as to be substantially perpendicular to the longitudinal axis of the B strip 14, with the A strip 12 also tightened in position with its longitudinal axis substantially perpendicular to the longitudinal axis of the B strip 14. The golf ball 58 is placed about halfway between the A strip 12 and the C strip 16 and a putter 66 is used for striking the ball 58 such as to cause the ball to travel in the appropriate direction, remaining equidistant from the A strip 12 and the C strip 16 during the first portion of the ball path. In the configuration of FIG. 9, the device 10 of the invention thus provides an alignment gauge for putting shots.

The slot 36 in the A strip 12 enables the user of the device of the invention to move back the ball position up to three ball positions for pitching or chipping. The slot 36 is not absolutely necessary and may be omitted to reduce the cost of the golf stance and swing practice device 10 of the invention.

A golf stance and swing practice device 10 according to the present invention has been made of high impact styrene plastic in the form of flat strips 40" long, 2" wide and ⅛" thick, making the A strip 12, B strip 14 and C strip 16. When disassembled, the three strips therefore occupy a space of 40"×2"×⅜", when superimposed, and they can be easily stored in an enclosure sleeve and carried in a golf bag.

Having thus described the present invention by way of a practical example of structure, given for illustrative purpose only, modification whereof will be apparent to those skilled in the art, what is claimed as new is as follows:

1. A golf stance and swing practice device comprising a first elongated flat strip provided with a substantially longitudinal slot, a first scale on a surface of said first strip, a second elongated flat strip pivotably and adjustably attached to said first strip along said slot, a second scale on a surface of said second strip indicating distances from an edge of said first strip, and a third elongated flat strip pivotably attached at one end of said first strip, said third strip having on a surface golf ball placement locations in the form of circles of a diameter equal to that of a golf ball, said second and third strips having a portion of longer length extending on one side of said first strip than on the other side and being generally disposed at an adjustable angle of 70° to 90° to said first strip with said second scale extending from an edge of said first strip and said golf ball placement locations being disposed on the portions of longer length of respectively said second strip and said third strip, wherein said second scale is a reference scale for adequate stance for a golfer having placed one foot at a corner of said second strip and said other side of said first strip and said first scale indicates the distance at which said golfer is to stand for hitting with a predetermined golf club a golf ball placed at a predetermined distance from said third strip in alignment with one of said ball placement locations on said third strip.

2. The device of claim 1 wherein at least said third strip has an aperture at each end thereof for attachment to the ground by anchoring means passed through said aperture.

3. The device of claim 1 wherein said third strip has a longitudinal slot for pivotal and longitudinally adjustable attachment at the end of said first strip.

4. The device of claim 1 further comprising a line tangent to each of said circles, said line being substantially perpendicular to the longitudinal axis of said third strip.

5. The device of claim 1 further comprising angle indicating graduations on said first strip for adjusting said third strip relative to said first strip at said angle of 70° to 90°.

6. The device of claim 5 further comprising angle indicating graduations on said second strip for adjusting said second strip relative to said first strip at said angle of 70° to 90°.

7. The device of claim 1 further comprising angle indicating graduations on said second stirp for adjusting said second strip relative to said first strip at said angle of 70° to 90°.

* * * * *